US009869158B2

(12) United States Patent
Vavik

(10) Patent No.: US 9,869,158 B2
(45) Date of Patent: Jan. 16, 2018

(54) DEEP WATER DRILLING RISER PRESSURE RELIEF SYSTEM

(71) Applicant: MHWIRTH AS, Kristiansand (NO)

(72) Inventor: Dag Vavik, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 14/917,275

(22) PCT Filed: Jun. 27, 2014

(86) PCT No.: PCT/EP2014/063715
§ 371 (c)(1),
(2) Date: Mar. 8, 2016

(87) PCT Pub. No.: WO2015/036137
PCT Pub. Date: Mar. 19, 2015

(65) Prior Publication Data

US 2016/0215587 A1 Jul. 28, 2016

(30) Foreign Application Priority Data

Sep. 10, 2013 (NO) ..... 20131221

(51) Int. Cl.
*E21B 34/04* (2006.01)
*E21B 21/00* (2006.01)
(Continued)

(52) U.S. Cl.
CPC ..... *E21B 34/04* (2013.01); *E21B 17/01* (2013.01); *E21B 21/001* (2013.01); *E21B 21/08* (2013.01)

(58) Field of Classification Search
CPC ..... E21B 34/04; E21B 17/01; E21B 21/08; E21B 21/001
See application file for complete search history.

(56) References Cited

U.S. PATENT DOCUMENTS 3,643,751 A * 2/1972 Crickmer ..... E21B 17/01 166/355
3,815,673 A 6/1974 Bruce et al.
(Continued)

FOREIGN PATENT DOCUMENTS

WO WO 00/75477 A1 12/2000

OTHER PUBLICATIONS

M. J. Chustz: "Managed-Pressure Drilling With Dynamic Annular Pressure-Control System Proves Successful in Redevelopment Program on Auger TLP in Deepwater Gulf of Mexico, paper IADC/SPE 108348", 2007 IADC/SPE Managed Pressure Drilling and Underbalanced Operations Conference and Exhibition, pp. 1-11 (2007).

(Continued)

*Primary Examiner* — Matthew R Buck
*Assistant Examiner* — Aaron L Lembo
(74) *Attorney, Agent, or Firm* — Norman B. Thot

(57) ABSTRACT

A deep water drilling riser pressure relief system includes a drilling riser extending from a surface down to a BOP stack arranged subsea. The drilling riser comprises a drilling riser slip joint, an annular preventer arranged below the drilling riser slip joint, and at least one pressure relief device arranged in a lower part of the drilling riser. The at least one pressure relief device is configured to open so as to discharge a fluid from the drilling riser to the sea if a pressure difference between an inside and an outside of the drilling riser exceeds a predetermined threshold.

11 Claims, 6 Drawing Sheets

(51) Int. Cl.
*E21B 21/08* (2006.01)
*E21B 17/01* (2006.01)

(56) References Cited

U.S. PATENT DOCUMENTS

| | | | | |
|---|---|---|---|---|
| 4,046,191 | A | 9/1977 | Neath | |
| 4,063,602 | A | 12/1977 | Howell et al. | |
| 6,668,943 | B1 | 12/2003 | Maus et al. | |
| 9,157,285 | B2 * | 10/2015 | Orbell | E21B 17/085 |
| 9,500,053 | B2 * | 11/2016 | Leuchtenberg | E21B 33/038 |
| 2004/0065440 | A1 | 4/2004 | Farabee et al. | |
| 2008/0105434 | A1 | 5/2008 | Orbell et al. | |
| 2008/0251257 | A1 | 10/2008 | Leuchtenberg | |
| 2011/0100710 | A1 | 5/2011 | Fossli | |
| 2011/0297388 | A1 | 12/2011 | Stave | |
| 2012/0227978 | A1 * | 9/2012 | Fossli | E21B 21/001 166/363 |
| 2013/0118752 | A1 * | 5/2013 | Hannegan | E21B 47/0005 166/336 |
| 2013/0118806 | A1 | 5/2013 | Hannegan et al. | |

OTHER PUBLICATIONS

API RP 64: "Recommended Practice for Diverter Systems Equipment and Operations", Second Edition, American Petroleum Institute, pp. 1-76 (2001).

API RP 520: "Sizing, Selection, and Installation of Pressure-Relieving Devices in Refineries, Part II—Installation", Fifth Edition, American Petroleum Institute, pp. 1-42 (2003, Reaffirmed 2011).

API 521: "Pressure-relieving and Depressuring Systems", Fifth Edition, American Petroleum Institute, pp. 1-206 (2007, Addendum 2008).

API RP 14 C: "Recommended Practice for Analysis, Design, Installation, and Testing of Basic Surface Safety Systems for Offshore Production Platforms", Seventh Edition, American Petroleum Institute, pp. 1-104 (2001, Reaffirmed 2007).

API RP 520: "Sizing, Selection, and Installation of Pressure-relieving Devices in Refineries, Part I—Sizing and Selection", Eighth Edition, American Petroleum Institute, pp. 1-148 (2008).

* cited by examiner

DEEP WATER DRILLING RISER PRESSURE RELIEF SYSTEM

CROSS REFERENCE TO PRIOR APPLICATIONS

This application is a U.S. National Phase application under 35 U.S.C. §371 of International Application No. PCT/EP2014/063715, filed on Jun. 27, 2014 and which claims benefit to Norwegian Patent Application No. 20131221, filed on Sep. 10, 2013. The International Application was published in English on Mar. 19, 2015 as WO 2015/036137 A2 under PCT Article 21(2).

FIELD

The present invention deals with a new and safer way of preventing a drilling riser from being exposed to overpressure.

BACKGROUND

As the oil and gas industry are going to deeper water, inadvertent gas entry into the drilling riser is a challenge due to the fact that the high static pressure at the seabed causes the gas to be highly compressed and in dense phase. There are basically two ways of handling inadvertent gas entry into the drilling riser: divert or shut-in.

Before 2001, the recommended practice for the oil and gas industry was to divert as outlined in the 1st edition of API RP 64:

"In drilling operations utilizing subsea preventer equipment where gas may have passed the blowout preventers immediately before they are closed on a kick or where gas may surface after being trapped below the blowout preventer in normal kill operations, a diverter system should be considered to divert gas and wellbore fluids when the marine drilling riser unloads."

In 2001, a new industry standard was described, giving a recommended practice to partly shut-in the drilling riser as stated in 2nd edition of API RP 64:

"In some designs, a mud/gas separator is utilized in the diverter system to separate the gas from the mud and return the mud to the system. Again, the design should not allow the diverter to completely shut-in the well."

In recent years, a number of Managed Pressure Drilling (MPD) and Underbalanced drilling (UBD) solutions have been developed which also completely or partially shut-in the well and drilling riser, or by other means apply backpressure to the well and drilling riser. However, these new solutions have been developed without any regulatory requirement to follow the basic safety analysis outlined in API RP 14C. API RP 14C was originally developed for Offshore Production Platforms, but also applies to Well Testing and Associated Well Control System.

The purpose of applying API RP 14C safety analysis and basic safety systems is to prevent undesirable events that could result in personnel injury, pollution or facility damage. One undesirable event can be overpressure. Overpressure is pressure in a process component in excess of the maximum allowable working pressure. Overpressure for a drilling riser can be caused by:

a) the static pressure of the drilling riser fluids in addition to the dynamic pressure loss in annulus exceeding the maximum allowable working pressure for the drilling riser, b) inflow to the drilling riser exceeding outflow from the drilling riser, c) the drilling riser being partly or fully shut-in and gas rapidly expanding in the drilling riser faster than the outflow from the drilling riser, or d) a combination of a), b) and c) above.

In some previous designs (as shown, for example, in FIG. 1), the drilling riser 3 has been partly shut-in by closing both the diverter line 10, the diverter element 11 and the mud return flowline 12, and the drilling riser fluids have been routed to a Mud Gas Separator (MGS) 13, as described in 2nd edition of API RP 64.

However, handling gas that has inadvertently entered into the drilling riser 3 by this method is unsafe because as the gas travels up the drilling riser 3, it will expand rapidly and push an accelerating liquid slug in front. Since there are no means for controlling the flow to the MGS 13, a typical result of such a design will be an undesirable event such as overfilling the MGS 13. Overfilling the MGS 13 will result in flooding the entire MGS vent line 23 to an outlet elevation typically four meter above the derrick. This will also increase the pressure in the drilling riser 3 and diverter housing below the diverter element 11, equivalent to the additional hydrostatic pressure caused by the elevation difference between the diverter line 10 outlets and the MGS vent line 23 outlet. In a worst case scenario, this can then also lead to a second undesirable event, such as overpressure of the drilling riser 3 or slip joint 2.

Normally the slip joint 2 will be the weakest point in a drilling riser and diverter system. The diverter system normally includes a diverter element 11 and two diverter lines 10 provided with isolation valves in each line. The slip joint 2 is typically designed with one packer 14 used under normal drilling operation pressurized to 100 psi (6.9 bar) and a second packer 15 pressurized to 500 psi (34.5 bar), which should be automatically pressurized when the diverter element 11 is closed and fluid diverted through the diverter lines 10.

FIG. 2 shows a simplified schematic representation of a drilling riser gas handling system according to prior art where an annular preventer 1 is installed in the drilling riser 3 below the slip joint 2 and the flow is routed to a MGS 13 through a Pressure Control Valve (PCV) 6 and a Pressure Relief Valve (PRV) 20 located under said annular preventer 1. This design is a significant improvement compared to the prior art described above, since the applied backpressure will reduce the peak flow to the MGS 13 and gas can be vented in a more controlled manner. This design can be compared with opening a champagne bottle gentlly by holding back the pressure with one hand on the champagne cork rather than opening the bottle with both of your thumbs pushing on the cork.

However, this system is more complex with more risk for mechanical and/or human errors and the possibility to overpressure the drilling riser 3 since restricting the flow to the MGS 13 will necessarily result in a pressure increase in the drilling riser 3. For this reason, the Pressure Relief Valve (PRV) 20 is normally installed upstream the first isolation valve 22 in the return line 5 to the mud system or directly on the drilling riser 3 below the annular preventer 1.

Introducing PRVs on a topside installation with potential release of a large amount hydrocarbon gas requires a lot of safety considerations, and it is a challenge to follow the guidelines and standards outlined in the following API documentations;

API RP 14C—Recommended Practice for Analysis, Design, Installation, and Testing of Basic Surface Safety Systems for Offshore Production Platforms API Standard 520—Part I—Sizing and Selection Sizing, Selection, and Installation of Pressure-relieving Devices in Refineries.

API RP 520—Part II—Installation Sizing, Selection, and Installation of Pressure-relieving Devices in Refineries.

API Standard 521—Pressure-relieving and Depressuring Systems.

Although these API standards and recommendations are not made for normal drilling operations, many of the guidelines in these specifications also have relevance, especially when introducing PCV or other means of applying back pressure to the low pressure drilling riser. Some of the guidelines in these specs are discussed further in detailed description.

SUMMARY

In an embodiment, the present invention provides a deep water drilling riser pressure relief system which includes a drilling riser extending from a surface down to a BOP stack arranged subsea. The drilling riser comprises a drilling riser slip joint, an annular preventer arranged below the drilling riser slip joint, and at least one pressure relief device arranged in a lower part of the drilling riser. The at least one pressure relief device is configured to open so as to discharge a fluid from the drilling riser to the sea if a pressure difference between an inside and an outside of the drilling riser exceeds a pre-determined threshold.

BRIEF DESCRIPTION OF THE DRAWINGS

The present invention is described in greater detail below on the basis of embodiments and of the drawings in which.

DETAILED DESCRIPTION

Figure 1:
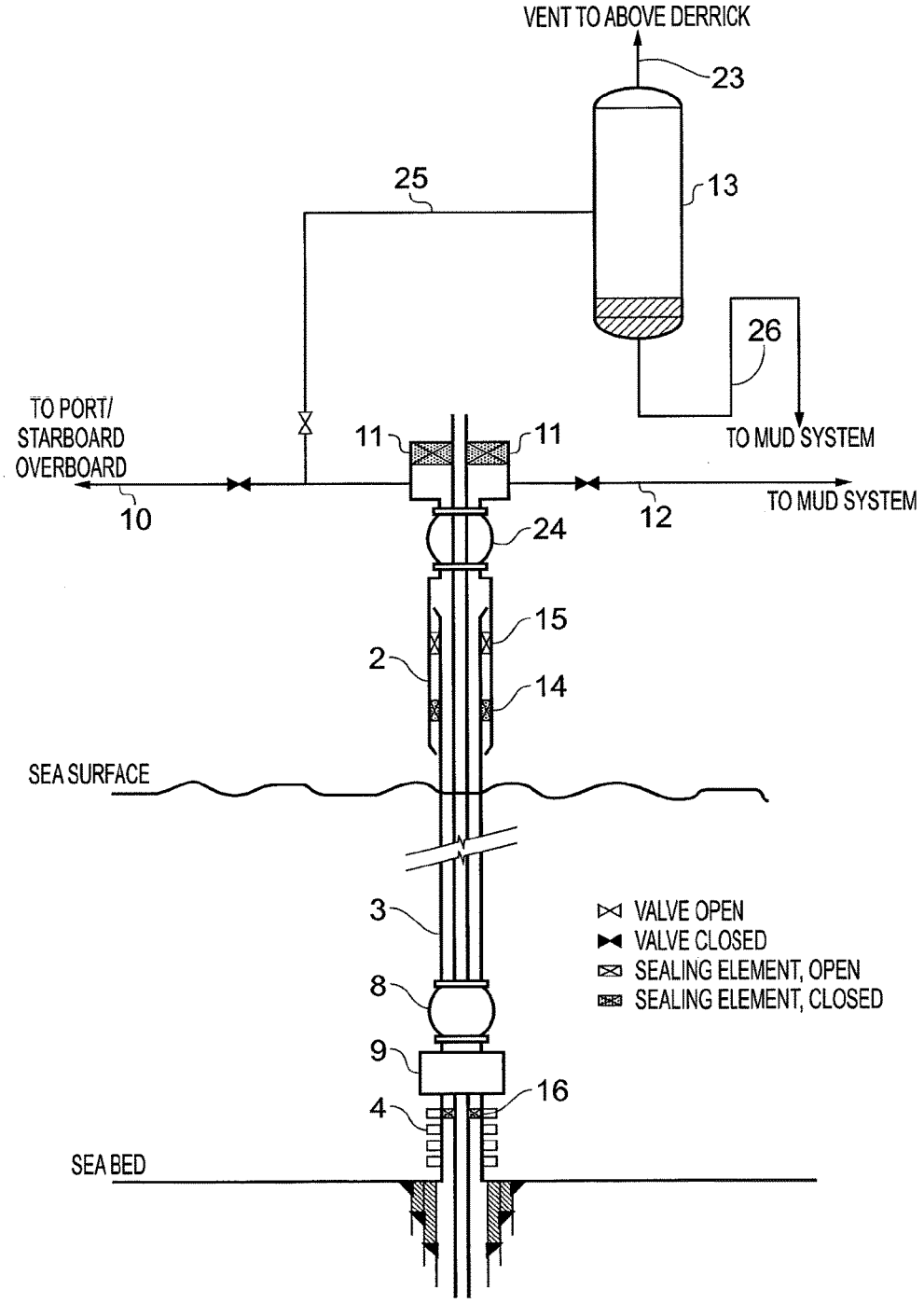
FIG. 1 (Prior Art)
FIG. 1 shows a simplified schematic representation of prior art.

The present invention relates to a deep water drilling riser pressure relief system, where the system comprises an annular preventer located below a drilling riser slip joint and wherein the annular preventer is connected to a drilling riser, the drilling riser extending from a surface down to a BOP stack arranged subsea, wherein at least one pressure relief device is arranged in the lower part of the drilling riser protecting the drilling riser from uncontrolled pressure build-up resulting in maximum allowable working pressure (MAWP) of the drilling riser being exceeded. In other words, the pressure relief device is adapted to e.g. fully open or break when the pressure difference between the inside and the outside of the drilling riser exceeds a predetermined value.

At least one fluid conduit, such as a return line, may be connected to a Mud Gas Separator, where the at least one fluid conduit may be arranged below the annular preventer.

In an aspect of the present invention, the system may further comprise a pressure control valve (PCV) or other means for applying backpressure to the drilling riser.

In an aspect of the present invention, the density of a drilling fluid inside the drilling riser may be chosen such that the pressure on the inside of the drilling riser is higher than the hydrostatic water pressure from the column of water on the outside of the drilling riser. At large depths, the hydrostatic pressure on the inside of the riser may be significant, resulting in a riser burst if the inside pressure of the riser increases above a certain value compared to the outside pressure, i.e. creating a large pressure difference between the inside and the outside of the riser.

The pressure relief device may in one embodiment have a fixed, predetermined relief set pressure value lower than either of a maximum allowable working pressure (MAWP) of a weakest drilling riser joint or a lower flex joint when taking the hydrostatic water pressure on the outside of the drilling riser into consideration.

In an aspect of the present invention, the pressure relief device (PRD) may be located below or just above the weakest drilling riser joint or the lower flex joint in the drilling riser, i.e. in the lower part of the drilling riser. The term 'lower part' should be understood as an area in the lower half of the drilling riser, normally closer to the sea bed. The location of the pressure relief device (PRD) may be at a depth such that the PRD is adapted to discharge drilling riser fluids directly to the water at a depth corresponding to a minimum depth where the drilling riser fluids are substantially dissolved in the surrounding water before reaching surface of the water.

In an embodiment of the present invention, the pressure relief device (PRD) may be an integrated part of the drilling riser joint or, alternatively, in another embodiment of the present invention, be fluidly connected to the drilling riser with minimum exit pressure loss.

In an embodiment of the present invention, the pressure relief device (PRD) may be a spring-loaded pressure relief valve arranged such that, after the drilling riser fluid has been discharged and pressure stabilized to below the maximum allowable working pressure of the drilling riser, the pressure relief valve will close.

In an alternative embodiment of the present invention, the pressure relief device may be a rupture disk adapted to rupture when a pressure differential between the inside of the drilling riser and the outside of the drilling riser exceeds an upper threshold value.

In an aspect of the present invention, the annular preventer may have a maximum allowable working pressure that can be larger than the maximum allowable working pressure for both a weakest drilling riser joint and lower flex joint, taking the inside and outside hydrostatic pressure into consideration.

The present invention also relates to the use of the pressure relief device as specified above, wherein the pressure relief device may be arranged in the lower part of a deep water drilling riser, and being configured for relieving pressure from an inside of the drilling riser to an outer pressurized environment surrounding the drilling riser.

The above and other characteristics of the present invention will be clear from the following description of an embodiment with reference to the drawings.

FIG. 1 discloses a typical arrangement according to prior art, disclosing a simplified schematic view of an arrangement according to 2nd edition of API RP 64. A Mud Gas Separator (MGS) 13 is fluidly connected through a line 25 to a diverter system 10, 11 to separate the gas from the mud and return the mud to the mud system via the MGS liquid seal 26, while both the diverter element 11 and diverter lines 10 are closed. A drilling riser 3 extends from a subsea BOP Stack 4, comprising shear rams and annular closing elements 16, through the sea up to the slip joint 2. The drilling riser 3 has a Lower Marine Drilling riser Package (LMRP) 9 above the BOP stack 4 and a lower drilling riser flex joint 8 arranged above said LMRP 9. The diverter element 11 and diverter lines 10 are arranged above an upper flex joint 24 and slip joint 2. The slip joint 2 is provided with two sets of sealing elements, a lower slip joint packer (100 psi, 6.9 bar) 14 and an upper slip joint packer (500 psi, 34.5 bar) 15. A mud return flow line 12 extends from the diverter housing to a mud system. The mud system normally comprises processing equipment topside, such as treatment equipment including shakers, degassers, desilters, desanders, sandtraps, etc., storage equipment including active and reserve mud tanks, mixing equipment including pumps and mixers, and different pumps.

Figure 2:
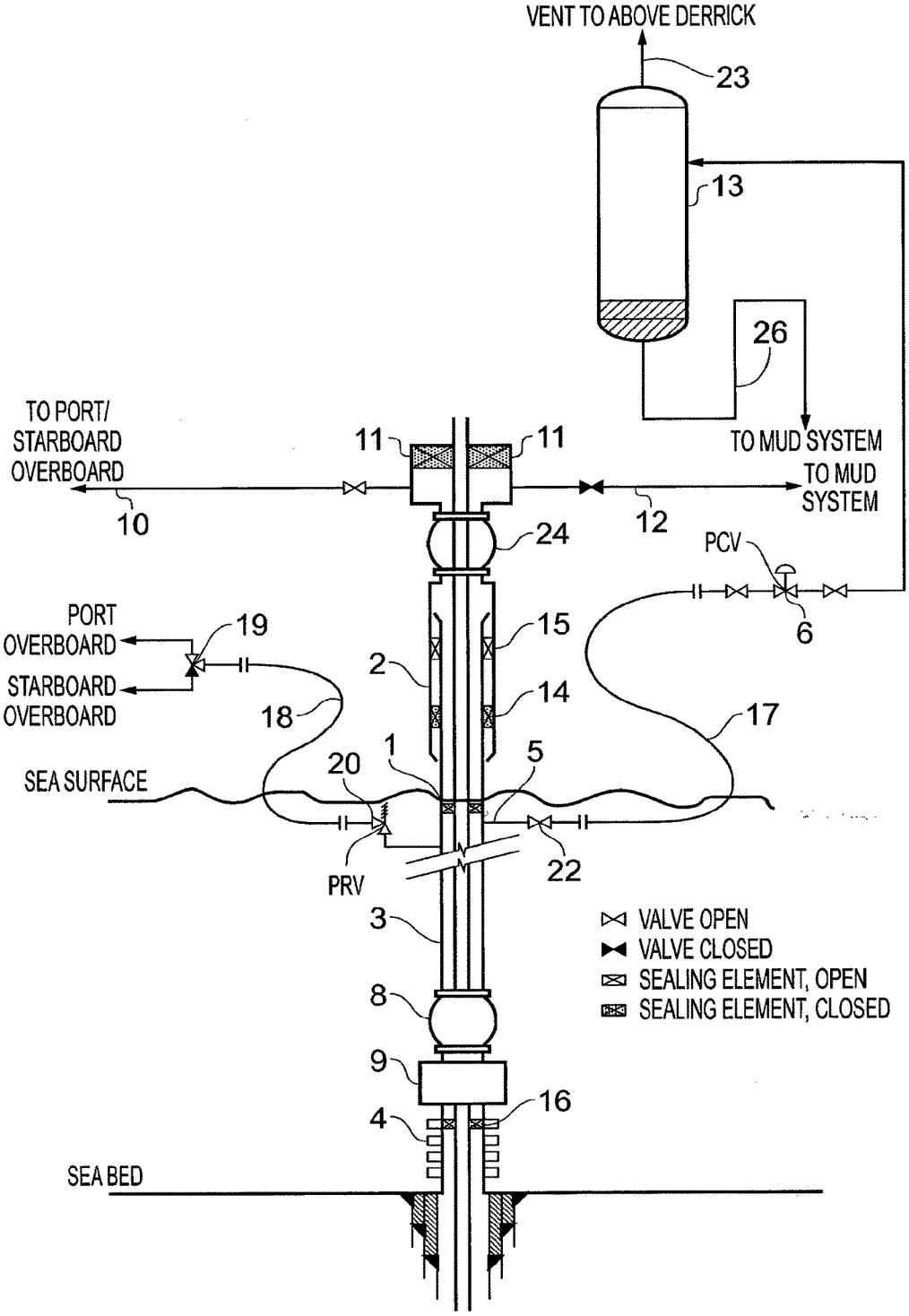
FIG. 2 (Prior Art)
FIG. 2 shows a simplified schematic representation of a drilling riser gas handling system according to prior art.

FIG. 2 is a simplified schematic representation of another drilling riser gas handling system according to prior art. The system of FIG. 2 has all of the same features as disclosed in FIG. 1, except that the MGS 13 is fluidly connected to the drilling riser 3 differently. The system is characterized by having an annular preventer 1 installed in the drilling riser 3 below the slip joint 2, and fluidly connected via a return line 5 connected to the drilling riser 3 below the annular preventer 1, through a pressure control valve (PCV) 6 arranged in a flexible hose 17 fluidly connected to return line 5 leading to the MGS 13. A pressure relief valve (PRV) 20 is located in the upper part of the drilling riser 3, below both the slip joint 2 and annular preventer 1. However, arranging the PRV 20 at this location has some HSE related issues.

Figure 3:
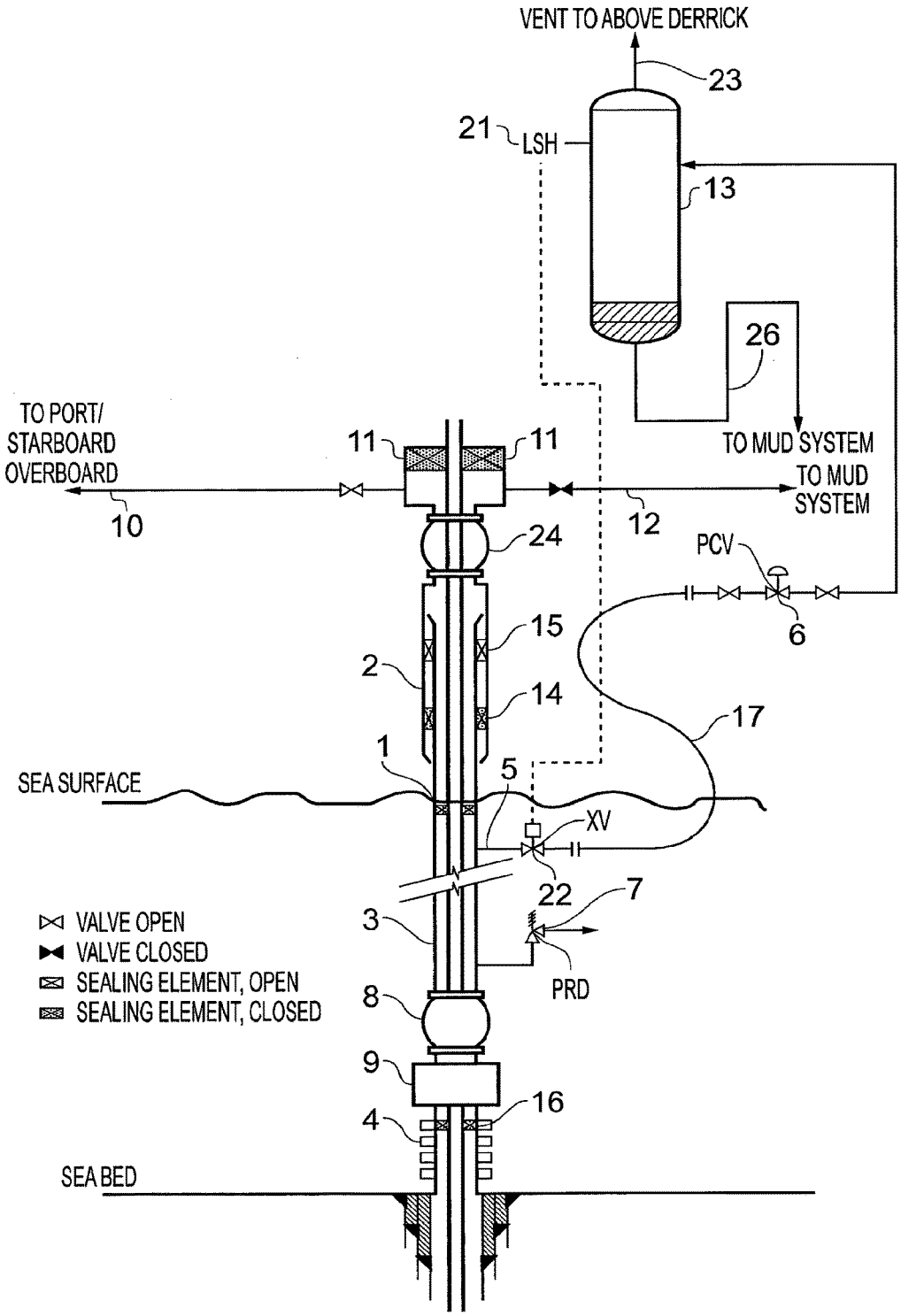
FIG. 3 discloses schematically an embodiment of the present invention.

FIG. 3 discloses schematically an embodiment of the present invention. The system has all of the same features as disclosed in FIG. 2, except that a pressure relief device (PRD) 7 is located in the lower part of the drilling riser 3, at the weakest drilling riser joint above the lower flex joint 8, taking the hydrostatic water pressure on the outside of the drilling riser 3 into consideration. In principle, the PRD 7 can be of any type, rupture disk or relief valve, but a spring-loaded pressure relief valve which will automatically close after pressure has been released is a solution to minimize the drilling riser fluid that will be emptied into the sea and to minimize pollution. The primary protection against overpressure of the drilling riser is taken care of by the following operating procedures: i) close the BOP stack 4 and or BOP annular preventer 16 on detection of a gas kick, ii) close the annular preventer 1, and iii) carefully bleed off any gas that inadvertently has entered the drilling riser 3, leading the gas slowly to the surface by regulating the PCV 6. To protect the MGS 13 from overfilling in case of fail open scenario of the PCV 6 or operating error, the MGS 13 is equipped with a level switch high (LSH) 21 which automatically shuts off inflow to the MGS 13 by closing the outlet valve 22 from the drilling riser 3 according to API RP 14C.

Figure 4:
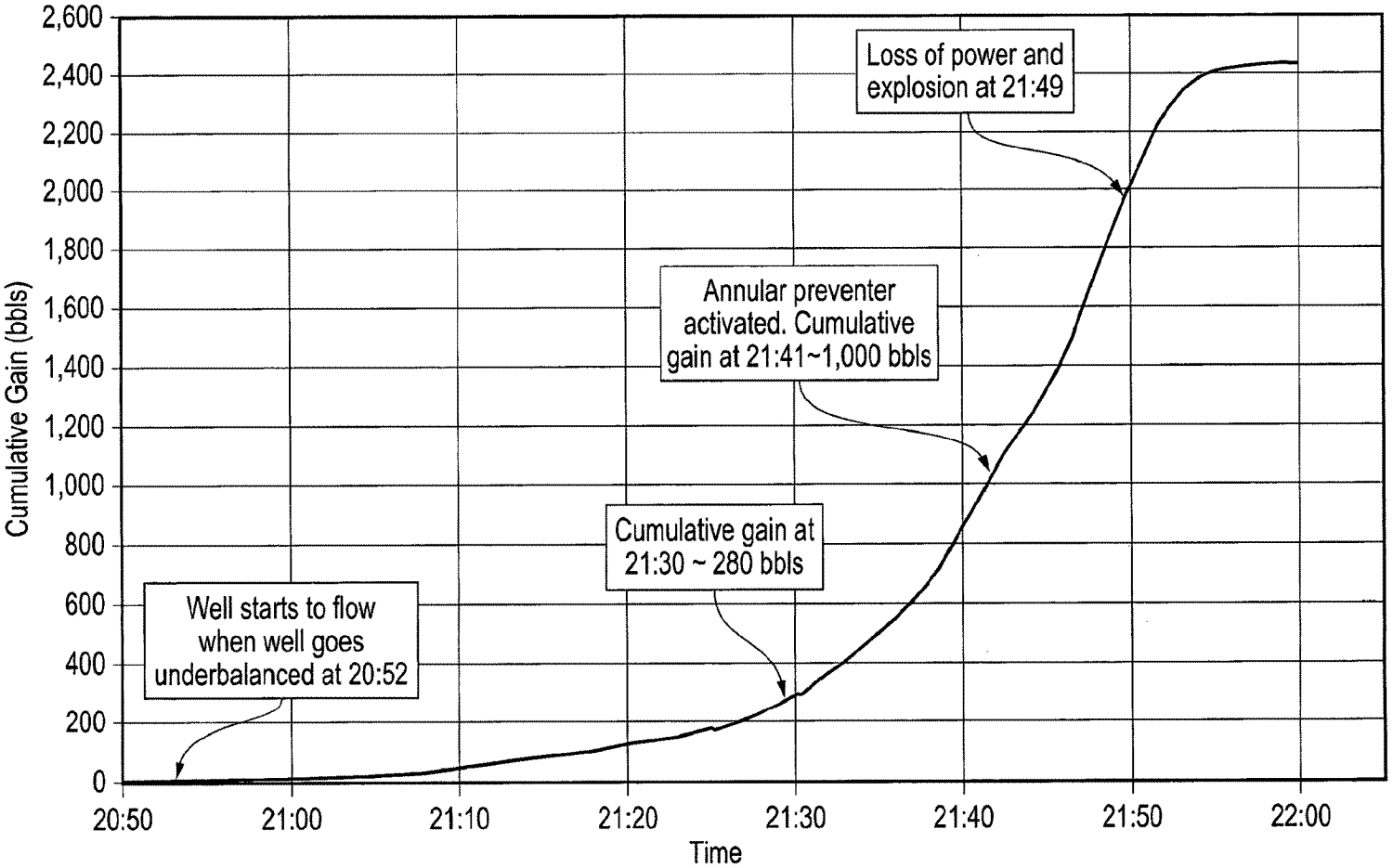
FIG. 4 is a diagram from the BP Accident Investigation Report.
Figure 5:
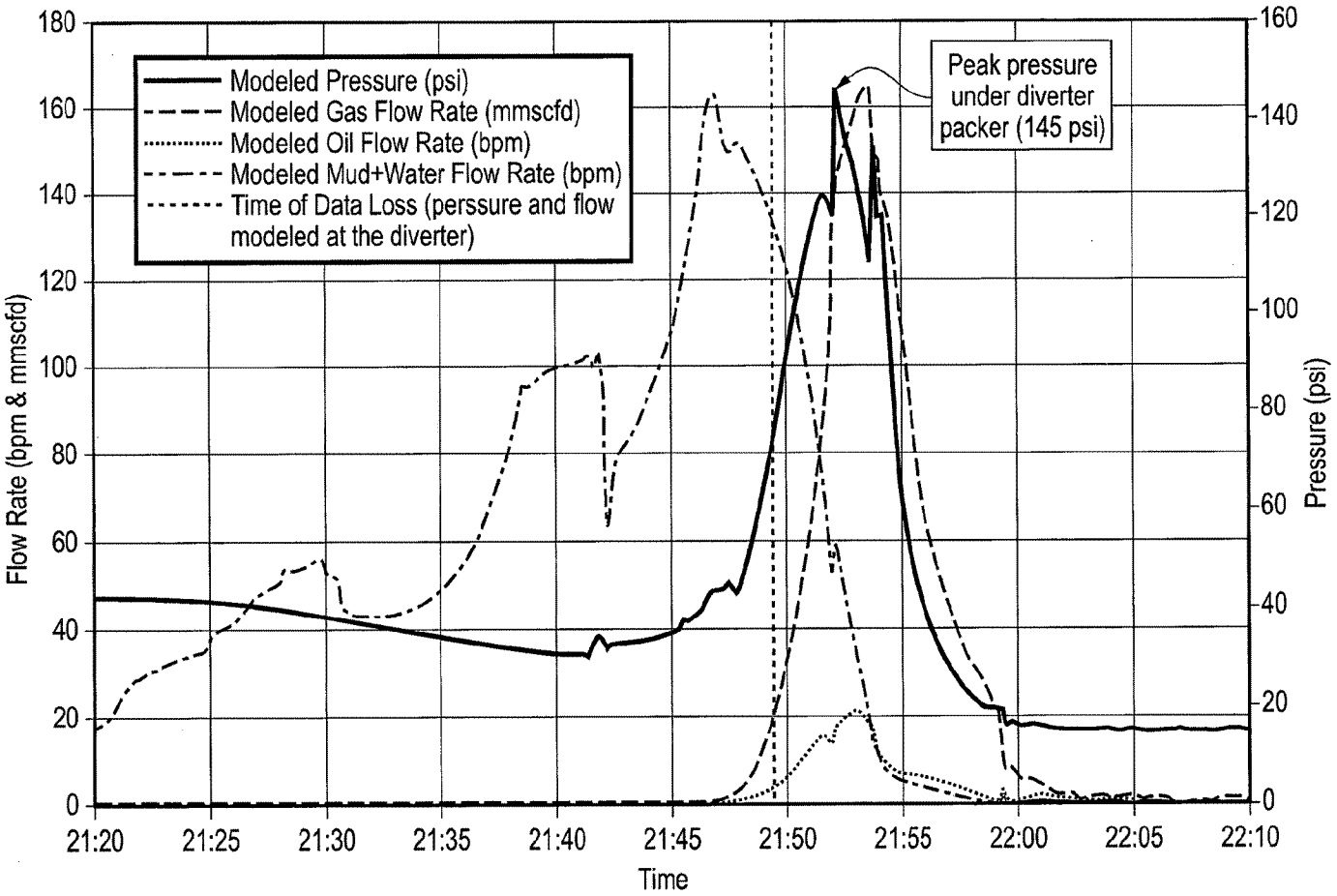
FIG. 5 is a diagram from the BP Accident Investigation Report.

FIGS. 4 and 5 are diagrams from the BP Accident Investigation Report. The report was issued Sep. 8, 2010. FIG. 4 is a diagram from Section 5, Analysis 5B, page 106 and shows that it took 49 minutes from the first influx until the BOP annular preventer was activated and shows that a kick of approximately 1000 bbl cumulative gain was taken during these 49 minutes. FIG. 5 is a diagram from section 5, Analysis 5C, page 117, and shows that the peak pressure under the diverter packer due to frictional loss in the vent pipes where approximately 145 psi, together with the peak liquid an gas flow rates.

Figure 6:
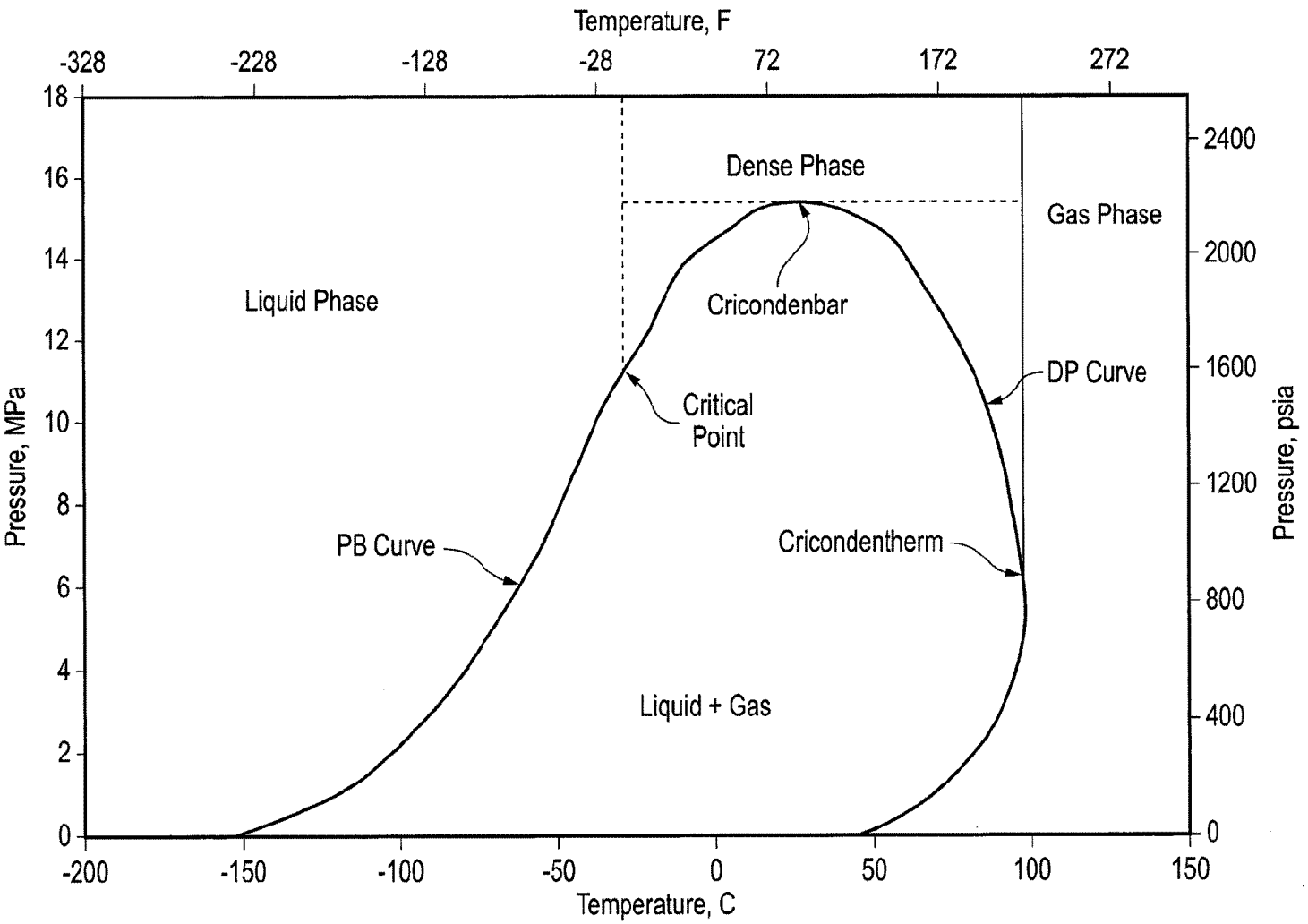
FIG. 6 is a simplified schematic of a typical natural gas identifying different phases and explaining the expression "dense phase".

FIG. 6 is a simplified schematic of a typical natural gas identifying different phases and explaining the expression "dense phase";

The advantages of the present invention of having the PRD 7 located in the lower part of the drilling riser, in deep water applications, compared to a PRV 20 located at the top of the drilling riser 3, are in the following paragraphs described and discussed in more detail:

a) Determination of PRD (PRV) Set Pressure

In general, a PRD 7 is installed to protect the process components (pipe, vessel, drilling riser, etc.) against overpressure and should not be set higher than the maximum allowable working pressure (MAWP) to the process component it is protecting. In a conventional design, there is however no need for a PRD 7 on the drilling riser 3, because the drilling riser 3 is designed for the heaviest mud density anticipated and the interlock in the diverter system 10, 11 provides that no back-pressure can be applied to the drilling riser 3.

When managed pressure drilling (MPD) solutions are implemented on a drilling unit there will be some means of applying back-pressure to the drilling riser 3 in a controlled manner. One way is implementing an annular preventer 1 that shuts off the return flow in the annulus and reroutes the returns from the drilling riser 3 back to the MGS 13 and mud system (not shown) through a PCV 6, as shown in FIG. 2.

However such a solution will require that a PRD 7 or a PRV 20 is installed upstream the first isolation valve (e.g. outlet valve 22) to protect the drilling riser 3 from overpressure.

EXAMPLE

A drilling riser 3 is designed for 10 000 ft (3048 meters) water depth and max anticipated mud density of 16 ppg (1917 kg/m$^3$). The lower drilling riser joints (from 7 500 ft (152.4 meters) down to 10 000 ft (3048 meters) water depth), has a MAWP of 4000 psi (275.8 bar). The lower flex joint is designed for 5000 psi (344.7 bar). The diverter housing is located 20 m above the operating draft. The lower flex joint 8 is located 20 m above the sea bed.

Case 1: The drilling unit are drilling at 9 000 ft (2743 meters) water depth, with 12 ppg (1438 kg/m$^3$) mud. However, the max anticipated (design mud weight) to be used for the well are still 16 ppg. To protect the lower drilling riser joint above the flex joint 8 from being exposed to overpressure, the PRD 7 has to be set at approx. 500 psi (34.5 bar) if it is located at top of the drilling riser 3 below the annular preventer 1. If the PRD 7 are located at the bottom of the drilling riser 3 above the lower flex joint 8, the set pressure will be 4000 psi (275.8 bar), which is equal to the MAWP of the lower drilling riser joint (difference between inside pressure and static outside seawater pressure).

Case 2: The drilling unit is relocated to a new location and drilling at 10 000 ft (3048 meters) water depth, with 12 ppg (1438 kg/m$^3$) mud. However, the max anticipated (design mud weight) to be used for the well is still 16 ppg (1917 kg/m$^3$). To protect the lower drilling riser joint above the flex joint 8 from being exposed to overpressure, the PRD 7 has to be set at approx. 100 psi (6.9 bar) if it is located at top of the drilling riser 3 below the annular preventer 1. If the PRD 7 is located at the bottom of the drilling riser 3 above the lower flex joint 8, the set pressure will still be 4000 psi (275.8 bar).

It should be noted that the primary protection (ref. API RP 14C, Chapter 4.2.1.1.3) against overpressure of the drilling riser 3 is by a continuously manned operation and operational procedures to close the BOP stack 4 and/or BOP annular preventer 16 on detection of a kick, close the annular preventer and carefully bleed-off any gas that inadvertently have entered the drilling riser 3. For this purpose, the operator can use the actual mud density in use at the time and adjust the PCV/PRD 20, 7 to apply backpressure to the drilling riser 3. This means that in case 1 and 2 above, since the drilling operation is with 12 ppg (1438 kg/m$^3$) mud, the operator can apply a backpressure of 2360 psi (162.7 bar) and 2180 psi (150.3 bar) respectively without overpressuring the drilling riser 3.

It should also be noted that the secondary protection (ref. API RP 14C, Chapter 4.2.1.1.4) against overpressure of the drilling riser 3 should be provided by a PSV (a pressure safety valve (PSV) is the same as a PRV 20 which is one type of PRD 7). The PSV/PRV 20 should, however, be sized according to the worst case scenario, (i.e. max anticipated mud weight), have a fixed set pressure, a fixed orifice size and the PSV discharge system and backpressure must be based on the worst case flow scenario. If the set pressure of a PSV is changed, this will also change the reliving flow rates and hence also the size of the PSV and discharge system. Changing the set pressure of the PSV according to the mud in use requires a complex calculation and might also affect the design of the system, and should therefore not be done by the operator. Reference is made to API Standard 521, Chapter 4.2.3, which also states that; "Operator error is considered a potential source of overpressure."

The secondary protection (PSV) should therefore be independent of operator procedures and manual input to provide it works properly if required.

The important consequence of this is that with a subsea PRD 7, the operator can apply a much higher backpressure to the drilling riser 3 when the actual density of the gas cut mud in the drilling riser 3 is below the max mud density used for the drilling riser design. In cases 1 and 2 above, the max backpressure the operator can apply without running the risk of the PRV accidently opens, is 500 psi (34.5 bar) and 100 psi (6.9 bar) respectively with a conventional PRV 20 located on top of the drilling riser 3. With a subsea PRD 7, the max backpres sure the operator can apply without running the risk of the PRV accidently opening is 2360 psi (162.7 bar) and 2180 psi (150.3 bar), respectively.

To be able to apply a higher backpressure on top of the drilling riser 3, it is important to reduce the peak flow rates and hence the size of the topside equipment (PCV 6, MGS 13, etc.) in the case of inadvertent gas in the drilling riser after the BOP is shut in on a kick. In other words, throttling on PCV 6 will reduce the flow rates to the MGS 13, but at the same time increase the backpressure on top of the riser 3. The effect of applying backpressure on top of the drilling riser can be compared with opening a champagne bottle gentle by holding back the pressure with one hand on the champagne cork rather than opening the bottle with both of your thumbs pushing on the cork.

It is also important during MPD to apply backpres sure on top of the drilling riser 3 to compensate for the pressure loss created when mud is circulated from bottom of the hole and back to the mud system. Typically, this pressure will be in the order of 500 psi-2000 psi (34.5 bar-137.9 bar) that is applied to the top of the drilling riser 3 during connection when the circulation of mud is stopped. This will not be possible in case 1 and 2 above without changing the set point of the topside PRV 20. With a subsea PRD 7 however, the reliving pressure will be constant set at the MAWP of the drilling riser 3, without any changes depending on the mud density in use.

b) Determination of PRD/PRV Relieving Rates

Determining the required relieving rates for the drilling riser PRD/PRV 7, 20 is a complex calculation and requires both advanced dynamic hydraulic simulation programs such as OLGA or Drillbench and good engineering judgement.

API Standard 521, Chapter 5.1 concerning the determination of individual relieving rates and principal sources of overpressure also states that; "Good engineering judgment, rather than blind adherence to these guidelines, should be followed in each case. The results achieved should be economically, operationally and mechanically feasible, but in no instance should the safety of a plant or its personnel be compromised."

There are two main factors which determine the required PRD/PRV relief rate:

The amount of hydrocarbon influx that inadvertently has entered into the drilling riser when the BOP is shut in on a kick.

How much applied backpres sure the drilling riser can take on top of the drilling riser, at relieving conditions.

The amount of hydrocarbon that will get past the subsea BOP and into the drilling riser will depend on water depth, how early the influx is detected and operator response time. How early the influx can be detected can be improved by implementing more accurate flow meters (Coriolis) in the return line 5 to the mud system and get a better control of flow rate coming back and hence give an early gain alarm.

Concerning operator response time, API Standard 521, Chapter 4.2.3 states that:

"The decision to take credit for operator response in determining maximum relieving conditions requires consideration of those who are responsible for operation and an understanding of the consequences of an incorrect action. A commonly accepted time range for the response is between 10 min and 30 min, depending on the complexity of the plant. The effectiveness of this response depends on the process dynamics."

The maximum allowable surface back pressure (MASBP) that can be applied to the drilling riser is depending on water depth and mud density. The drilling risers are normally optimized and designed for a certain max water depth and mud density. When drilling close to the max water depth, mud density MASBP is reduced to a minimum. MASBP as low as 100-500 psi can typically be the case when drilling at maximum water depth and maximum mud density. Hence, the pressure relief system (PRV and discharge system) should therefore be designed accordingly, in order to keep the pressure on top of the drilling riser below the MASBP.

Again referring to FIG. 5, it can be seen that the peak mud/water flow rate of 163 bpm and a peak gas flow rate of 165 mmscfd was calculated using the dynamically simulation program OLGA. These flow rates have been used to check out the size of the PRV in Case 1 and Case 2 in the example above. The result can be seen in the table below. The PRV sizing is based on API Standard 520—Part I—Sizing and Selection, and for pure liquid and gas flow rate (not 2-fase flow).

TABLE 1

PRV size based on 163 bpm (1555 $m^3/h$) liquid flow rate and 500 psi MASBP.

| Description | PRV set pressure (psi) | PRV orifice type according to API. | PRV orifice size (inch 2) | Number of PRV's required. | PRV flange size in/out (inch) |
|---|---|---|---|---|---|
| Topside PRV | 500 | R | 16.00 | 1 | 6" × 10" |
| Subsea PRV | 4000 | Q | 11.05 | 1 | 6" × 8" |

TABLE 2

PRV size based on 165 mmscfd (160000 kg/h) gas flow rate and 500 psi MASBP.

| Description | PRV set pressure (psi) | PRV orifice type according to API. | PRV orifice size (inch 2) | Number of PRV's required. | PRV flange size in/out (inch) |
|---|---|---|---|---|---|
| Topside PRV | 500 | Q | 11.05 | 1 | 6" × 8" |
| Subsea PRV | 4000 | J | 1.287 | 1 | 2" × 3" |

TABLE 3

PRV size based on 163 bpm (1555 $m^3/h$) liquid flow rate and 100 psi MASBP.

| Description | PRV set pressure (psi) | PRV orifice type according to API. | PRV orifice size (inch 2) | Number of PRV's required. | PRV flange size in/out (inch) |
|---|---|---|---|---|---|
| Topside PRV | 100 | T | 26.00 | 3 | 8" × 10" |
| Subsea PRV | 4000 | Q | 11.05 | 1 | 6" × 8" |

TABLE 4

PRV size based on 165 mmscfd (160000 kg/h) gas flow rate and 100 psi MASBP.

| Description | PRV set pressure (psi) | PRV orifice type according to API. | PRV orifice size (inch 2) | Number of PRV's required. | PRV flange size in/out (inch) |
|---|---|---|---|---|---|
| Topside PRV | 100 | T | 26.00 | 2 | 8" × 10" |
| Subsea PRV | 4000 | J | 1.287 | 1 | 2" × 3" |

The following conclusion and consideration with respect to PRV sizing should be noted:

As peak gas relieving rates also occur simultaneous with some liquid relief, the PRV is undersized for the gas relieving cases.

A topside PRV with set point 100 psi is not practical, and will require 3 large PRVs in parallel and 3×10" hoses and a large manifold/divert system topside.

A minimum 500 psi set pressure should be used for the topside PRV. Note also that the last 1000 ft of drilling riser in Case 2 above has to be reinforced in order to increase the MASBP from 100 psi to 500 psi.

The subsea PRV is dramatically smaller for the gas relieving cases since the gas is compressed and in dense phase, while with a topside PRV, the gas will expand due to lower set pressure and discharge to the atmosphere.

It should also be noted that the subsea PRV is oversized for the liquid relieving cases. The reason for this is that the peak liquid flow rate used in the calculation is based on a topside relief system where gas expands as it travels up the drilling riser, pushing an accelerating liquid slug unloading the drilling riser. With a subsea PRV however the gas will expand much slower because in order to travel up the drilling riser and expand, liquid will have to go the opposite way down to the subsea PRV. Consequently there will be no accelerating slug traveling up the drilling riser. The dimensioning criteria for a subsea PRV would then typically be full circulating mud flow with max circulating capacity and then a sudden accidental blockage of topside annular preventer and mud return line. A typical max circulating flow rate can be 2000 gpm (454 $m^3/h$), see table 5 below.

TABLE 5

Subsea PRV size based on maximum liquid circulating rate of 2000 gpm (454 $m^3/h$) liquid flow rate.

| Description | PRV set pressure (psi) | PRV orifice type according to API. | PRV orifice size (inch 2) | Number of PRV's required. | PRV flange size in/out (inch) |
|---|---|---|---|---|---|
| Subsea PRV | 4000 | L | 2.853 | 1 | 3" × 4" |

This calculation shows that for a subsea PRV, a valve with an API orifice L type (2.853 inch2) and 3" inlet flange and 4" outlet flange, ref table 5 above, will also cover any gas release scenario.

For a topside PRV, however, consideration to max inadvertent influx into the drilling riser, water depth, maximum mud density and MASBP the drilling riser can handle must be considered in each case. To reduce the size of topside PRV and discharge piping, consideration to reinforce the drilling riser to get a higher MASBP should be considered. This is especially important when the drilling unit is operating in water depths close to the limit of the design water depth of the drilling riser.

c) PRV Discharge System Requirements

For a subsea PRV system the emergency relief system or secondary protection against overpressure will be to discharge the fluids directly to sea. No discharge system is required, since the PRD 7 is located subsea close to the seabed, see FIG. 3.

A topside emergency relief or depressurization system for potential hydrocarbon influx into the drilling riser would, if API Standard 521 should be followed, normally require a complete system consisting of discharge piping, large knock-out drum and a large flare/vent to relive the gas safely. However a "cold" discharge directly overboard can be acceptable, but then a 3-way valve 19 is recommended to discharge the fluid on the leeward side of the drilling unit, see FIG. 2.

Since the PRV is protecting the drilling riser, which is connected to the seabed, a flexible hose 18 or similar is required if a topside relief system are to be designed on the floating drilling unit. In general, the use of hoses should be avoided since it is a greater risk for leakage. A potential large gas release in the moonpool area is a safety concern. It is also a general concern that both the PRV and the hoses will be located in the splash zone (or just under) and needs to be protected and designed for the weather conditions it should be used for.

Furthermore, a flexible hose and the location of the PRV on top of the drilling riser but below the annular preventer 1 and the slip joint 2 will create a low point where water or drilling fluids may collect. Ref. also API RP 520—Part II—Installation, Chapter 8.1 states that; "Discharge piping from pressure-relief devices must be drained properly to prevent the accumulation of liquids on the downstream side of the pressure-relief device."

Mud in the discharge piping may settle out and create a blockage if not drained or removed properly. Water in the discharge piping is specially a concern in cold areas where the fluid may freeze and create an ice block.

Consideration of auto-refrigeration due to Joule-Thomson effect during discharge through the PRV should be evaluated. Piping design, including material selection, must consider the expected discharge temperature to avoid brittle fracture due to low temperature. The possibility to plug the discharge piping due to hydrate formation should also be considered.

Backpressure calculation in the discharge piping system must be calculated and checked according to API Standard 520—Part I—Sizing and Selection. Discharge pressure drop calculation will be needed both for selection of size and type of the PRV and discharge piping. Special consideration due to two-phase flow during peak gas reliving conditions must be considered.

d) Safety and Environmental Considerations

As the oil and gas industry is going to deeper water, inadvertent gas entry into the drilling riser is a challenge due to the high static pressure at sea level which causes the gas to be highly compressed and in dense phase. When the gas is in dense phase, the fluid has a viscosity similar to that of a gas, but a density closer to that of a liquid. Dense phase for a typical natural gas occurs when the pressure typically is above 154 bar, see FIG. 6. For water depth deeper than approximately 1540 meter the gas will be in dense phase also on the outside of the drilling riser due to the static pressure of seawater. On the inside of the drilling riser the gas can be in dense phase all the way up to typically 1000 meter water depth depending on mud density and applied surface back pressure. Inadvertent gas in the drilling riser therefore needs to be handled in a safe way and follow the basic safety analysis outlined in API RP 14C in order to avoid undesirable events such as overfilling the MGS or overpressuring the drilling riser.

The primary protection against overpressure of the drilling riser is taken care of by operating procedures to close the BOP stack 4 and the BOP annular preventer 16 on detection of a kick, close the annular preventer 1 and carefully bleed-off any gas that inadvertently have entered the drilling riser 3 leading the gas slowly to the surface by regulating the PCV 6. As explained earlier one of the important consequences of the described embodiment, is that with a subsea PRD 7 the operator can apply a much higher surface backpressure to the drilling riser 3 when the actual density of the gas cut mud in the drilling riser 3 are below the max mud density used for the drilling riser 3 design. To protect the MGS 13 from overfilling in case of fail open scenario of the PCV 6 or operating error, the MGS 13 should be equipped with a level switch high (LSH) 21 which automatically shuts off inflow to the vessel by closing the outlet valve 22 from the drilling riser 3 according to API RP 14C, see FIG. 3.

The safety advantage with a subsea PRD 7 as shown in FIG. 3, compared with topside PRV 20 as shown in FIG. 2 for a secondary protection against overpressure are mainly explained in paragraph a), b) and c) above. However, consideration to what happens if hydrocarbons are released directly to sea needs to be evaluated in each case . . . . If the a subsea PRD 7 are to be used for shallow waters, further work is recommended to check at what water depth the gas released subsea will come as a gas plume braking the surface creating a gas cloud that might be a safety risk for the drilling unit. In any case potential release from a secondary protection system against overpressure subsea will have less environmental consequences compared to a discharge at the sea surface.

The present invention has been described in non-limiting embodiments. It is clear that the person skilled in the art may make a number of alterations and modifications to the described embodiments without diverging from the scope of the invention as defined in the attached claims.

What is claimed is:

1. A deep water drilling riser pressure relief system comprising:

a drilling riser extending from a surface down to a BOP stack arranged subsea, the drilling riser comprising, a drilling riser slip joint, an annular preventer arranged below the drilling riser slip joint, and at least one pressure relief device arranged in a lower part of the drilling riser, wherein, the at least one pressure relief device is configured to automatically open so as to discharge a fluid from the lower part of the drilling riser to the sea if a pressure difference exceeds a pre-determined pressure threshold, and the predetermined pressure threshold does not exceed a maximum working allowable pressure of the lower part of the drilling riser, the maximum working allowable pressure being a difference between an inside pressure of the lower part of the drilling riser and a hydrostatic water pressure on an outside of the lower part of the drilling riser.

2. The system as recited in claim 1, further comprising:

a mud gas separator, and at least one fluid conduit configured to extend from the drilling riser below the annular preventer to the mud gas separator.

3. The system as recited in claim 2, further comprising:

a pressure control valve arranged in the at least one fluid conduit.

4. The system as recited in claim 1, wherein, the drilling riser further comprises a weakest drilling riser joint and a lower flex joint, and a pre-determined pressure threshold is lower than a maximum allowable working pressure of one of the weakest drilling riser joint and the lower flex joint under consideration of the hydrostatic water pressure on the outside of the lower part of the drilling riser.

5. The system as recited in claim 4, wherein the annular preventer has a maximum allowable working pressure that is larger than the maximum allowable working pressure of each of the weakest drilling riser joint and the lower flex joint.

6. The system as recited in claim 4, wherein the at least one pressure relief device is located below one of the weakest drilling riser joint and the lower flex joint in the drilling riser.

7. The system as recited in claim 4, wherein the pressure relief device is located above one of the weakest drilling riser joint and the lower flex joint in the drilling riser.

8. The system as recited in claim 1, wherein, the drilling riser further comprises a drilling riser joint, and the at least one pressure relief device is integrated in the drilling riser joint.

9. The system as recited in claim 1, wherein the at least one pressure relief device is a spring-loaded pressure relief valve.

10. The system as recited in claim 1, wherein the at least one pressure relief device is a rupture disk.

11. The system as recited in claim 1, wherein the at least one pressure relief device is further configured to automatically close after the discharge the fluid from the lower part of the drilling riser.

* * * * *